United States Patent [19]

Phillips et al.

[11] 3,940,826

[45] Mar. 2, 1976

[54] PORTABLE SURFACE CLEANER

[75] Inventors: Paul E. Phillips, Whitehall; Wilfred C. Nise, Spring Lake; Jack L. Hommes, Muskegon; Dale E. Lowder, North Muskegon, all of Mich.

[73] Assignee: Clarke-Gravely Corporation, Muskegon, Mich.

[22] Filed: Oct. 12, 1973

[21] Appl. No.: 405,916

[52] U.S. Cl. ..... 15/320; 15/345; 15/353

[51] Int. Cl.[2] ..... A47L 7/00

[58] Field of Search ..... 15/320, 321, 353, 345, 15/346; 415/53

[56] References Cited

UNITED STATES PATENTS

| | | | |
|---|---|---|---|
| 1,211,948 | 1/1917 | Koster et al. | 15/320 X |
| 1,948,366 | 2/1934 | Barzen | 415/53 |
| 3,663,984 | 5/1972 | Anthony et al. | 15/321 |
| 3,676,889 | 7/1972 | Edlin | 15/320 |
| 3,761,987 | 10/1973 | Nayfa et al. | 15/320 X |
| 3,774,260 | 11/1973 | Emus | 15/321 |

*Primary Examiner*—Harvey C. Hornsby
*Assistant Examiner*—C. K. Moore
*Attorney, Agent, or Firm*—Price, Heneveld, Huizenga & Cooper

[57] ABSTRACT

The specification discloses a surface cleaning apparatus having a molded plastic housing and an upwardly and rearwardly projecting casing terminating at a handle, the lower portion of the housing including a forward suction nozzle, opening into a recovery chamber. Suction is generated by a blower at the rear of the recovery chamber and a shield positioned in front of the blower prevents liquid from being drawn from the recovery chamber into the blower. A pump removes liquid in the recovery chamber through a hose which empties into a remote drain. A parallel pump tubing causes recycle of liquid through the pump whenever liquid in the recovery chamber is depleted to prevent dry running of the pump. A set of spray nozzles located in the apparatus just behind the suction nozzle is connected through a hose to a faucet which acts as a remote source of clean water. The clean water supply tubing connects to the nozzles through a positive flow additive injector. The clean water supply tubing is also directly connected to the recovery tank through a bypass tubing so as to further aid in preventing dry operation of the pump and to cause additive flow even when source water pressure is low. The blower is shrouded so that air is evacuated downwardly from the blower into the surface being cleaned. A conveniently located handle switch is wired such that whenever clean water and additive are being sprayed onto the floor, the pump also operates. A separate switch enables one to run the pump only in the event the recovery tank gets too full.

24 Claims, 8 Drawing Figures

PORTABLE SURFACE CLEANER

BACKGROUND OF THE INVENTION

The present invention relates to surface cleaning apparatus, and particularly to apparatus for cleaning carpets. One of the most popular types of carpet cleaners utilized today is the steam cleaner. These devices employ a carriage upon which a large clean water tank and a large recovery tank are mounted. Such devices are quite bulky and difficult to transport. Further, the clean water tank must be repeatedly filled and the dirty water tank must be repeatedly emptied. Also the distance between the suction nozzle used in conjunction with the steam cleaner and the blower or impellor which is mounted on the recovery tank causes the requirement of a very high-powered blower in order to generate enough suction to remove excess water from the carpet. The noise generated from such large blowers causes operator discomfort.

In order to place the blower in close proximity to the suction nozzle, patent application, Ser. No. 352,623, entitled SURFACE CLEANING APPARATUS, invented by Terry H. Jones and John T. Oakes, filed on Apr. 19, 1973 and patent application Ser. No. 405,819, entitled SURFACE CLEANING APPARATUS, invented by Terry H. Jones, filed on even date herewith, both assigned to the assignee of this application, show a portable sink connected surface cleaner and an improved version of the same utilizing a blower mounted in a housing in close proximity to a suction nozzle to effect a more efficient suction. This surface cleaner utilizes a small recovery tank between the suction nozzle and blower, with a shield mounted generally in front of the blower. A set of spray nozzles is mounted rearward from the suction nozzle and sprays cleaning fluid on the carpeted surface. A pump pumps the recovered used cleaning water from the recovery chamber to a remote source of discharge.

Though this surface cleaner is a great improvement over the prior art surface cleaners, many problems are associated with the cleaner. First of all, when the intermediate recovery chamber is pumped empty, the pump is dry operated causing severe wear and damage to the internal workings of the pump and to the pump motor due to overheating. Also, since the device utilizes a remote source of cleaning fluid supply such as a plumbing fixture, fluctuations in source pressure hinder efficient operation of the device. Whenever source pressure is low, additive flow into the cleaning fluid is retarded or may even stop, and whenever the source pressure is too great the recovery tank may become overfilled, and eventually will spill over the shield into the blower. Also, a constant concentration of additive in the cleaning fluid is not maintained when the source pressure fluctuates, since the additive is injected into the cleaning fluid flow due to an aspirator effect regulated by water volume through the injector. Another problem associated with the Jones device is that the housing mounted blower is loud and causes discomfort to the operator.

SUMMARY OF THE INVENTION

In the present invention, a portable surface cleaning apparatus comprises a used cleaning fluid recovery chamber, a suction nozzle opening into the recovery chamber, a blower means in flow communication with the recovery chamber for effecting a rapid evacuation of air from the recovery chamber, a spray nozzle for spraying cleaning fluid onto the surface being cleaned, mounted rearward from the suction nozzle, a pump connected to the recovery chamber for pumping used cleaning fluid out of the recovery tank to a remote discharge area, and a parallel pump bypass tubing connected between the outlet and inlet of the pump for preventing dry running of the pump. A remote source of supply of cleaning fluid is connected to the spray nozzles and a bleed-off system is mounted ahead of the spray nozzle from the cleaning fluid supply source directly into the used cleaning fluid recovery chamber. The bleed-off causes a constant flow of cleaning fluid directly into the recovery chamber, so as to further prevent dry operation of the discharge pump.

Also used in conjunction with this invention is a positive flow additive injector, which allows a flow of additive into the cleaning fluid based on the flow of the cleaning fluid to the spray nozzles. The aforementioned bleed-off from the cleaning fluid supply directly into the recovery chamber causes additive flow even when source pressure is relatively low.

A conveniently located handle switch is wired such that whenever clean water and additive are being sprayed onto the floor, the pump also operates. Preferably this switch requires constant pressure and is placed into a contoured handle grip which is incorporated into the handle. A separate switch mounted on the handle enables one to run the pump only in the event that the recovery tank becomes overfilled. The electrically powered elements of the surface cleaner essentially comprise a water shut-off valve or solenoid, which controls the flow of cleaning fluid to the spray nozzle, the discharge pump and the blower. Preferably an indicator light is mounted on the handle and is activated whenever current is present in the wiring system of the cleaner. In the preferred embodiment whenever current is supplied to the cleaner by plugging into an outlet source and by engaging a handle mounted off-on switch, the blower is operating.

Finally, a shrouding is mounted over the blower so that noise associated with its continual operation is significantly reduced. Further, the shrouding allows a downward venting of the discharge air so as to either precondition the carpet surface being cleaned with the discharge air or to dry the somewhat wetted already cleaned surface. Downward venting of the discharge air from the shrouding into the surface being cleaned further reduces blower noise, so the apparatus operator may extensively use the cleaner without excessive sound associated discomfort.

These and other objects and advantages of the present invention will be more fully understood and appreciated by reference to the written specification and appended drawings.

DESCRIPTION OF THE PREFERRED EMBODIMENT

Figure 1:
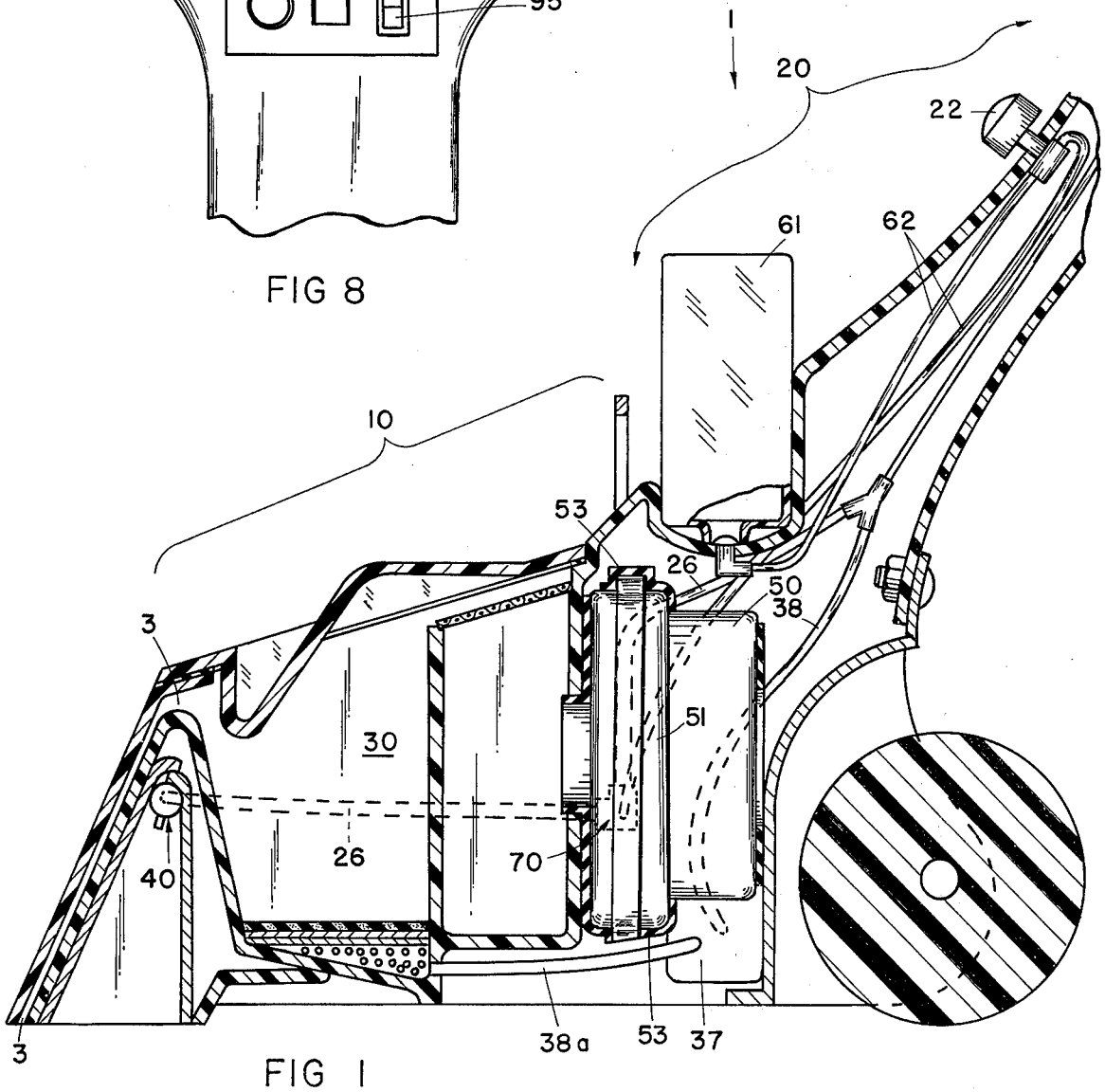
FIG. 1 is a vertical cross-sectional view of the cleaner taken approximately along the center of the cleaner.
Figure 4:
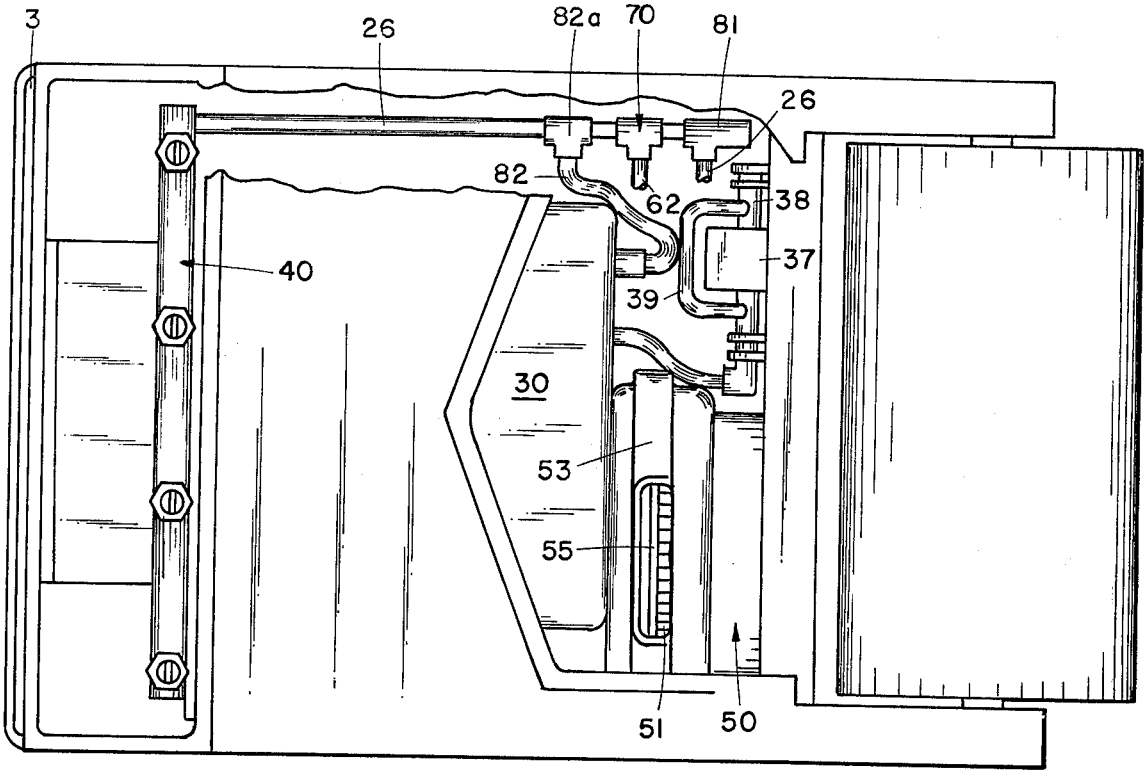
FIG. 4 is a bottom view of the cleaner.
Figure 5:
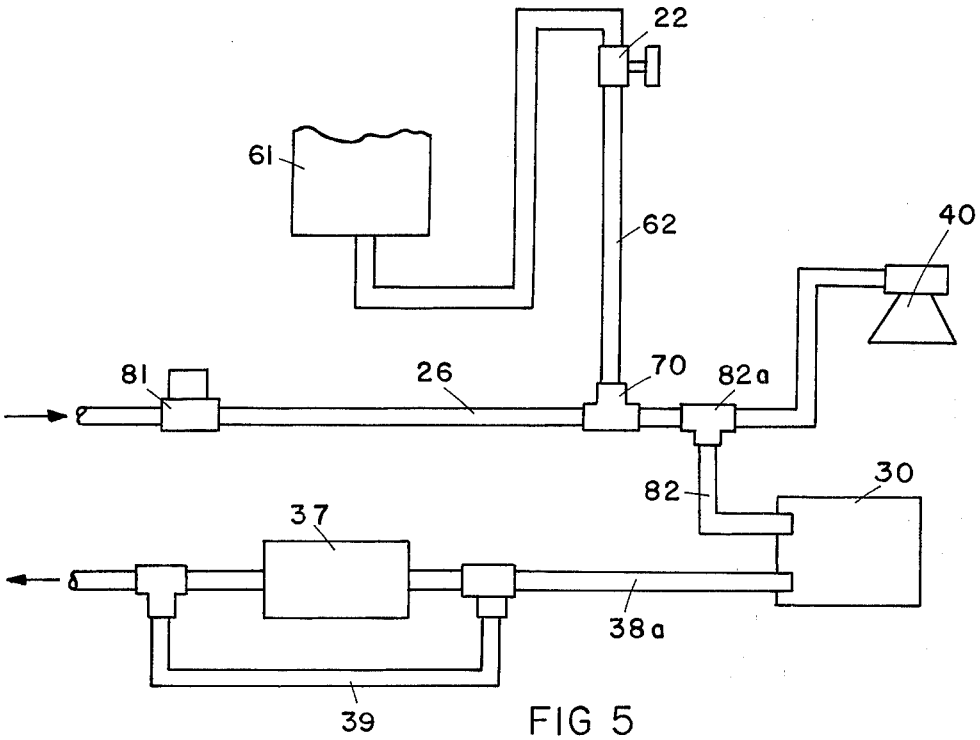
FIG. 5 is a schematic diagram of the cleaning fluid supply, discharge, and additive system.

In the preferred surface cleaning apparatus 1 of this invention, a housing 10 containing a suction nozzle 3 opening into a recovery chamber 30 has connected thereto a blower 50, which causes a rapid evacuation of the air from the recovery chamber 30 and thus generates a large amount of suction (FIG. 1). The supply tubing 26 connects spray nozzles 40 to a remote source of cleaning supply. The spray nozzles are mounted rearward of the suction nozzle 3, so that when the cleaning apparatus is operated the cleaning fluid is sprayed from the nozzles 40 onto the surface being cleaned and removed immediately therefrom by suction nozzle 3. The used cleaning fluid is recovered in chamber 30 wherein it is separated from its associated air. A pump 37 in communication with recovery chamber 30 removes the used cleaning fluid to a remote source of discharge (FIGS. 1, 4 and 5). A pump bypass tubing 39 prevents dry operation of the pump when the fluid in recovery chamber 30 is depleted. A bleed-off tubing 82 connected between the supply tubing 26 and recovery chamber 30 causes a continual flow of cleaning fluid into the recovery chamber so as to further prevent dry operation of the pump 37. A positive flow additive injector 70 causes a flow of additive from additive container 61 into supply tubing 26. The bleed-off tubing 82 causes additive flow from injector 70 even when source pressure in tubing 26 is low. A handle mounted dead man's switch 97 deactivates solenoid 81 preventing further flow of cleaning fluid from supply tubing 26 to the spray nozzles 40 in the event that recovery chamber 30 begins to get too full. A handle mounted switch 96 activates pump 37 so that the excess used cleaning fluid in chamber 30 is depleted. A rubber deflector shrouding 53 is placed over the impellor 51 of the blower 50 to muffle blower noise by downwardly directing the air flow from the blower directly into the carpet being cleaned. The carpeting itself serves as a sound deadener. Further, the downwardly directed air acts either to precondition the carpet being cleaned or to aid in drying of the already wetted surface.

Referring to the drawings, FIG. 1 shows that surface cleaner 1 comprises a roller-mounted lower housing 10 which is substantially rectangular having an open bottom and an integrally molded upper control casing 20. Lower housing 10 is provided with a suction nozzle 3 in the forward most part of the housing. An air passageway connects the nozzle 3 to a cleaning fluid recovery chamber 30 mounted in housing 10, generally in front of nozzle 3.

Figure 2:
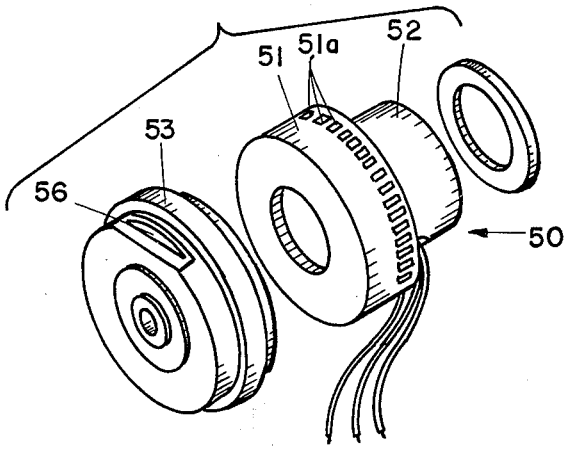
FIG. 2 is an exploded perspective view of the blower and its deflector shroud.
Figure 3:
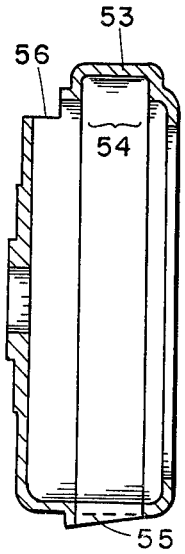
FIG. 3 is a vertical cross-sectional view of the blower deflector shroud taken approximately through the center of the deflector shroud.

Blower means 50, comprising an impellor 51 driven by motor 52 is positioned within the housing and is in communication with the recovery chamber 30. Impellor 51 exhausts air through a number of circumferentially spaced openings 51*a*. A shrouding 53 (shown also in FIGS. 2 and 3) surrounds the impellor 51. It is made of plastic, rubber or the like which is sufficiently heat resistant to avoid deterioration from the heat generated by blower 50 and is molded to correspond closely to the shape of the impellor housing of blower 50. The shrouding 53 closely fits around impellors 51 and motor 52 so that air flow from the shrouding 53 is restricted. Shrouding 53 includes a circumferential channel 54 therein which fits over the exhaust ports 51*a* of impellor 51. As seen in FIG. 4, air from ports 51*a* flows through channel 54 to a shrouding vent 55 at the bottom thereof which downwardly directs impellor exhaust air. The exhaust air is directed into the surface being cleaned, so as to muffle the noise generated by the blower. An additional benefit is derived in that the surface being cleaned may be preconditioned for cleaning by the air discharged from vent 55 or the air may act to dry a wetted surface. While an opening 56 into shroud 53 is also visible at the top of shroud 53, this is merely a locating notch to allow the overall blower assembly to be fitted tightly against internal walls within housing 10. Opening 56 is in practical effect closed by the internal walls against which this portion of blower 50 abuts.

As seen in FIG. 1, cleaning fluid spray nozzles 40 are mounted behind nozzle 3 within housing 10. Supply tubing 26 is connected at one end to nozzles 40 and at its other end to a remote source of supply of cleaning fluid. The cleaning fluid may be water, which is preferably hot, so that the remote source of supply may be a pumping fixture.

Figure 6:
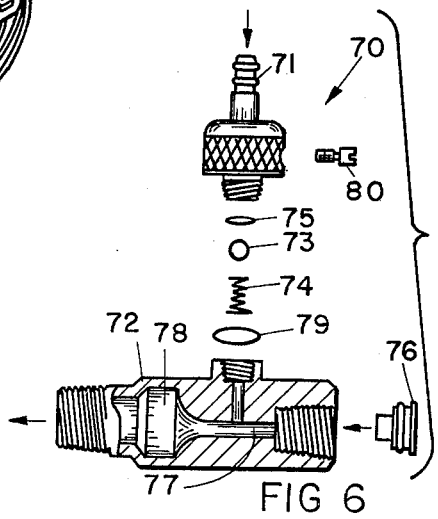
FIG. 6 is an exploded, partially cross-sectional view of the positive flow injector.

As shown by FIG. 1 and schematic FIG. 5, additive is provided by container 61 which is fixedly held in a well where control casing 20 attaches to lower housing 10. Container 61 supplies additive through tubing 52 which runs through control casing 20 into adjustment valve 22 and thereafter into positive flow injector 70. Referring to FIG. 6, additive flows into a venturi type injector valve 70 through nipple 71 into the valve body 72. The nipple 71 is threaded into the valve body 72 and acts to encase flow elements, which consist of a check valve including ball 73, spring 74, and gaskets 75 and 79. As supply fluid flows into valve body 72 through seating element 76 and through aperture 77, effective fluid pressure is reduced in valve chamber 78 because of the flange effect of the body 72 internal structure. As long as effective fluid pressure in chamber 78 is less than entrance pressure, the ball 73 will displace spring 74 thus unseating itself from the upper of gaskets 75 and additive will be drawn into the valve body 72 from the nipple 71.

If discharge from the valve chamber 78 is blocked or otherwise inhibited, supply intake pressure and spring 74 will cause seating of ball 73 into the upper gasket 75, thus preventing contamination of additive and/or backflow of cleaning supply fluid into the system. A bleed valve 80 allows air intake into the additive supply tubing 62 from nipple 71, so that air locks will not occur in tubing 62 and block fluid flow. A commercially available version of this injector is made by Dema Engineering Company of St. Louis, Mo.

Used cleaning fluid is removed from the recovery chamber 30 by pump 37 through a conduit 38*a*. It is then pumped out through discharge tubing 38. Discharge tubing 38 and supply tubing 26 extend from the apparatus in a coaxial arrangement and are joined by suitable fittings to a remote drain and faucet respectively. As seen in FIG. 4 and schematic FIG. 5 the parallel pump tubing 39 is connected by bypass valves at one end to tube 38*a* and at the other end to discharge tubing 38, thereby completing a circuit around pump 37. Preferably, discharge tube 38 extends upwardly from the point at which bypass tubing 39 joins it so that water will tend to collect at the juncture of tube 39 and tube 38. If the cleaning fluid level in chamber 30 is depleted, the bypass tubing 39 causes a recycle of used cleaning fluid from the pump exit to the pump intake port. By so doing, the pump is prevented from harmful dry running.

Also, seen in FIGS. 4 and 5, a bleed-off tubing 82 placed behind injector 70 at one end directly connects into the supply tubing 26 by bypass valve 82*a*. Bleed-off 82 at its other end connects and allows continued flow of the cleaning fluid directly to recovery chamber 30, bypassing the spray nozzle and suction nozzle. This continued flow directly to recovery chamber 30 further reduces the possibility of dry operation of pump 37. Also, additive flow will be assured even when supply pressure is low since the tube 82 will always act to lower the pressure in chamber 78 of the valve (see FIG. 6) causing additive flow into the injector valve 72.

As seen in FIGS. 4 and 5, a water shut-off valve or solenoid 81 is placed along tubing 26 so that when desired the water supply may be shut off at the cleaner without going to the remote source. The valve is electrically controlled by switch 97 and is placed upstream of injector 70, bleed-off 82 and nozzles 40, so that fluid flow to these elements is eliminated when switch 97 is not engaged. Also, the placement of valve 81 upstream of injector 70 insures that water shut-off valve 81 operates in only clean water. This extends the life of the valve by preventing detergent solution gum up.

Figure 8:
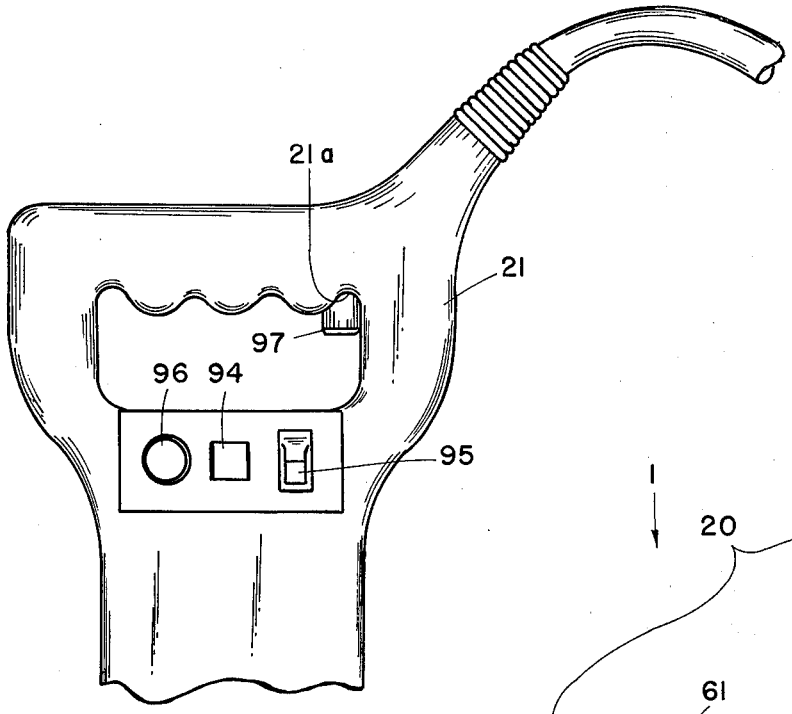
FIG. 8 is a fragmentary front view of the handle control center.
Figure 7:
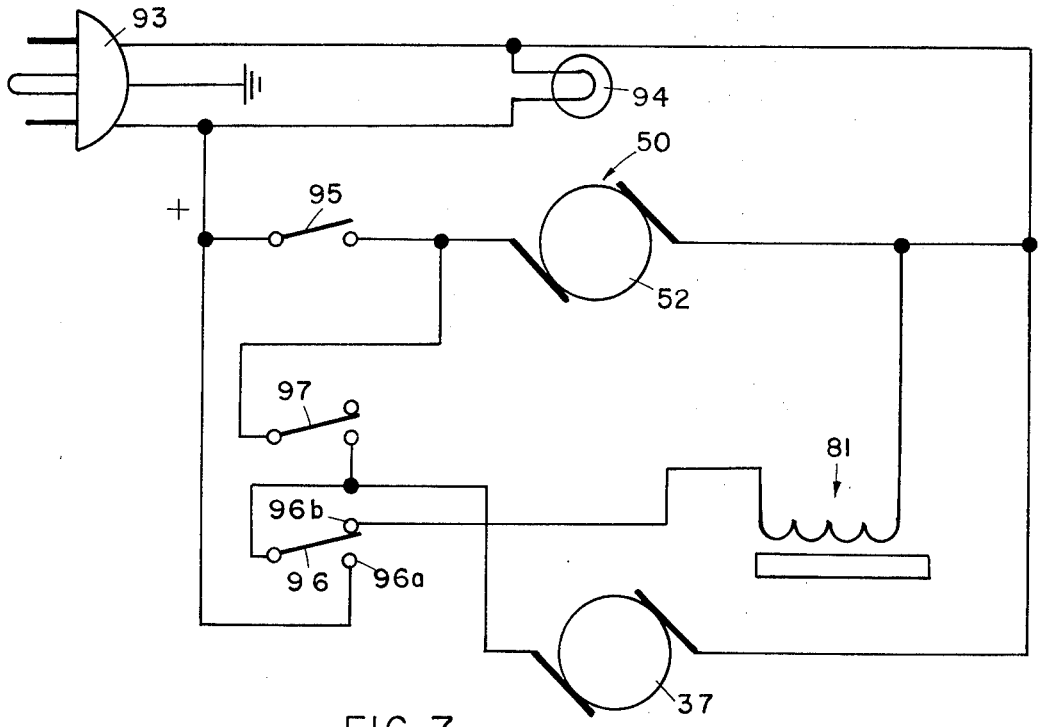
FIG. 7 is a schematic wiring diagram for the pump, vac motor and flow control for the cleaner.

In FIG. 7, the circuit diagram of the electrically powered elements of the apparatus 1 shows that power plug 93 connects the circuit into a conventional grounded wall plug. The handle 21 shown in FIG. 8 acts as a control center for the electrically powered elements of cleaner 1 by acting as a mounting for the circuit controls hereinafter discussed. A neon lamp 94 shown in FIGS. 7 and 8 is placed parallel into the circuit so that whenever voltage is present in the system, the lamp 94 will be on and so warn the operator. Power switch 95 acts as an on/off control for all the powered elements of apparatus 1, except that pump 37 can be operated independently of switch 95 if desired. Switch 95 is positioned in series with the motor of blower 50. When only this switch is engaged, neon light 94 and blower motor 52 are the only powered elements in the circuit operating. Switch 95 is in parallel with switch 96 through pole 96*a* thereof. Switch 96 then is in series with the motor of pump 37 to form a circuit which is parallel to the circuit of blower 50. When switch 96 is also engaged, pump 37 operates in conjunction with the light 94 and blower motor 52. Switch 95 is positioned in series with switch 97. Switch 97 in turn is in series with each of two parallel circuits and activates both when closed. One of these circuits is through the motor of pump 37. The other is through the second pole 96*b* of switch 96 and through the solenoid of solenoid valve 81. By disengaging switch 96 and engaging switch 97, the shut-off valve 81 is opened allowing a flow of cleaning fluid to the spray nozzles 40 and the pump 37 is also activated. In the preferred embodiment, switch 97 requires constant pressure to activate and is placed in finger receiving channel 21*a* of the contour grip of handle 21 as shown in FIG. 8 allowing ready accessability by the operator, since it may be the most actively used switch. The switch 97 is a "deadman" type switch which being spring loaded only closes the electrical circuit by constant pressure. Similarly, switch 96 is a "deadman" type and normally closes the circuit through solenoid valve 81 as shown in FIG. 7.

OPERATION

In operation, the supply tube 26 is connected to a remote supply source, e.g., a plumbing fixture. Pump 37 is in flow communication with a remote drain via discharge tube 38. Engagement of electrical switch 95 activates blower 50. After engagement of switch 95, switch 97 is closed by manual pressure of the operator on the grip switch. Pump 37 is activated, and solenoid 81 is opened, causing the cleaning fluid to spray on the surface to be cleaned from nozzle 40. Cleaning fluid also begins to run into the chamber 30 through bleed-off 82. Additive begins to flow from container 61 through the injector 70 into the cleaning fluid being transported to nozzle 40 by supply tubing 26. The operator by means of handle 21 pulls the cleaner 1 rearward and across the surface being cleaned. The used cleaning fluid is drawn upwardly in the direction of the air flow through suction nozzle 3 and into recovery chamber 30 where the air and water separate with the air being evacuated by blower 50 and the water being removed by pump 37. If the fluid level in recovery chamber 30 becomes too depleted bypass 39 prevents dry running of the pump 37 by allowing continuous recycle of the used cleaning fluid contained within the bypass. If a fluctuating cleaning fluid supply pressure exists, bleed-off 82 allows continual flow of additive from the positive flow additive injector 70 by draining cleaning fluid from supply tubing 26 downstream from the injector into recovery chamber 30 even under an extremely low cleaning fluid supply pressure.

The air which is evacuated from recovery chamber 30 by blower 50 is downwardly directed into the surface being cleaned by shrouding 53 through vent 55. The surface being cleaned and the shrouding 53 act to muffle the noise generated by the flow of air from the blower. When the switch 97 is activated and the cleaner is rearwardly directed across the surface being cleaned, the air being evacuated acts to precondition the surface being cleaned, i.e., fluffs the surface. After the completion of the cleaning pass of the device a switch 97 is deactivated and the cleaner is moved forward to be positioned for another cleaning pass. In so doing, the cleaner may be forwardly rolled over the partially wetted surface which was just cleaned and the outwardly directed blower discharge acts to dry the cleaned surface.

It it is desired to pick up excess cleaning fluid on the surface or to lower the used cleaning fluid level in the recovery tank 30, the switch 97 is opened and switch 96 is closed causing pump 37 to be engaged in addition to the blower 50. By so doing, the excess cleaning fluid is removed from the surface and the recovery chamber 30. If fluid level in the recovery chamber 30 becomes too low while operating only the blower 50 and pump 37, bypass 39 as discussed above prevents dry operation of the pump 37. To resume normal cleaning of the surface, switch 96 is deactivated and switch 97 is activated during the normal cleaning passes of the cleaner. After the cleaning operation is completed, one can completely turn off switch 95 and still operate pump 37 through switch 96 in order to finally pump all residual solution out of recovery chamber 30.

It will be understood that various changes in the details, materials, steps, and arrangements of parts, which have been herein described and illustrated in order to explain the nature of the invention, may be made by those skilled in the art within the principle and scope of the invention as described in the appended claims.

The embodiments of the invention in which an exclusive property or privilege is claimed are defined as follows:

1. A portable surface cleaning apparatus comprising: spray means for spraying cleaning fluid onto the surface being cleaned; a used cleaning fluid recovery chamber; a suction nozzle in flow communication with said recovery chamber; blower means in flow communication with said recovery chamber for generating a suction in said recovery chamber for causing air and used cleaning fluid to be drawn through said suction nozzle into said recovery chamber; pump means for pumping used cleaning fluid out of said recovery chamber to a remote discharge means; a discharge flow line extending from said recovery chamber, through said pump means and to a remote discharge means; and a bypass flow line connected to said discharge line upstream and downstream of said pump means to prevent dry running of said pump when liquid in said recovery chamber is depleted; said spray means including a cleaning fluid flow line operably connected to a source of cleaning fluid; a bleed-off line connected at one end to said cleaning fluid flow line and its other end to said recovery chamber, thereby short-circuiting a portion of the flow of cleaning fluid directly to said recovery chamber and thereby further preventing dry operation of said pump.

2. The apparatus of claim 1 comprising: a source of cleaning fluid additive to be injected into said cleaning fluid; venturi injector means positioned on said cleaning fluid flow line, said cleaning fluid additive source being operably connected to said venturi injector means whereby additive is injected into said cleaning fluid flow line; said bleed-off line being operably connected to said cleaning fluid flow line at a point downstream of said venturi injector whereby said bleed-off tends to decrease the water pressure downstream of said venturi injector and thereby facilitates operation of said venturi injector even in the event that pressure is low at the cleaning fluid source, upstream of said venturi injector.

3. The apparatus of claim 2 in which said cleaning fluid source comprises a water tap, said cleaning fluid flow line including means for operably connecting said cleaning fluid flow line to said water tap.

4. The apparatus of claim 2 in which said discharge flow line extends upwardly from its downstream point of juncture with said bypass flow line whereby fluid tends to accumulate at said juncture downstream of said pump means, thereby insuring a source of liquid to be recirculated through said pump means.

5. The apparatus of claim 2 comprising: a solenoid valve on said cleaning fluid flow line for effecting the opening and closing thereof and for thereby controlling the flow of cleaning fluid to the surface to be cleaned; said pump means including a motor; a first switch for controlling both said solenoid valve and said motor, said first switch being in a first circuit which is in series with each of second and third circuits, said second and third circuits being parallel to one another; said second circuit comprising said motor for said pump means; said third circuit comprising a second switch and said solenoid of said solenoid valve, said second switch being normally closed to said solenoid of said solenoid valve whereby closing of said first switch closes a circuit through said solenoid valve and through said motor for said pump, thereby simultaneously causing a flow of cleaning fluid to the suface being cleaned and causing used cleaning fluid to be pumped from said recovery chamber; said second switch being additionally a component of a fourth circuit, said fourth circuit being parallel to said first circuit and being in series with said second circuit whereby when said second switch is manually engaged to thereby open said third circuit, said fourth circuit is closed through said second circuit and said motor for said pump operates alone with said solenoid valve being closed and the flow of liquid to the surface being cleaned thereby shut off.

6. The apparatus of claim 5 including a fifth circuit comprised of a third switch and a motor for said blower means in series with one another; said third switch also being in series with said first circuit, said motor for said blower means being arranged in parallel with said first circuit and with said second and third circuits whereby said third switch acts as the main power switch for said motor for said blower means and said solenoid valve.

7. The apparatus of claim 5 including: shroud means over said blower means for directing the blower means discharge downwardly onto the surface being cleaned.

8. The apparatus of claim 1 in which said discharge flow line extends upwardly from its downstream point of juncture with said bypass flow line whereby fluid tends to accumulate at said juncture downstream of said pump means, thereby insuring a source of liquid to be recirculated through said pump means.

9. The apparatus of claim 1 comprising: a solenoid valve on said cleaning fluid flow line for effecting the opening and closing thereof and for thereby controlling the flow of cleaning fluid to the surface to be cleaned; said pump means including a motor; a first switch for controlling both said solenoid valve and said motor, said first switch being in a first circuit which is in series with each of second and third circuits, said second and third circuits being parallel to one another; said second circuit comprising said motor for said pump means; said third circuit comprising a second switch and said solenoid of said solenoid valve, said second switch being normally closed to said solenoid of said solenoid valve whereby closing of said first switch closes a circuit through said solenoid valve and through said motor for said pump, thereby simultaneously causing a flow of cleaning fluid to the surface being cleaned and causing used cleaning fluid to be pumped from said recovery chamber; said second switch being additionally a component of a fourth circuit, said fourth circuit being parallel to said first circuit and being in series with said second circuit whereby when said second switch is manually engaged to thereby open said third circuit, said fourth circuit is closed through said second circuit and said motor for said pump operates alone with said solenoid valve being closed and the flow of liquid to the surface being cleaned thereby shut off.

10. The apparatus of claim 9 including a fifth circuit comprised of a third switch and a motor for said blower means in series with one another; said third switch also being in series with said first circuit, said motor for said blower means being arranged in parallel with said first circuit and with said second and third circuits whereby said third switch acts as the main power switch for said motor for said blower means and said solenoid valve.

11. The apparatus of claim 9 comprising: a contoured handle grip shaped to define a plurality of finger receiving channels, said first switch being located within one of said finger receiving channels of said contoured handle grip whereby it is conveniently located for activation as an operator operates said apparatus.

12. A portable surface cleaning apparatus comprising: spray means for spraying cleaning fluid onto the surface being cleaned, said spray means including a cleaning fluid flow line operably connected to a source of cleaning fluid; a used cleaning fluid recovery chamber; a suction nozzle in flow communication with said recovery chamber; blower means in flow communication with said recovery chamber for generating a suction in said recovery chamber for causing air and used cleaning fluid to be drawn through said suction nozzle into said recovery chamber; pump means operably connected in flow communication with said recovery chamber for pumping used cleaning fluid out of said recovery chamber to a remote discharge means; a bleed-off line connected at one end to said cleaning fluid flow line and at its other end to said recovery chamber, thereby short-circuiting a portion of the flow of cleaning fluid directly to said recovery chamber and thereby preventing dry operation of said pump.

13. The apparatus of claim 12 comprising: a source of cleaning fluid additive to be injected into said cleaning fluid; venturi injector means positioned on said cleaning fluid flow line, said cleaning fluid additive source being operably connected to said venturi injector means whereby additive is injected into said cleaning fluid flow line; said bleed-off line being operably connected to said cleaning fluid flow line at a point downstream of said venturi injector whereby said bleed-off tends to decrease the water pressure downstream of said venturi injector and thereby facilitates operation of said venturi injector even in the event that pressure is low at the cleaning fluid source, upstream of said venturi injector.

14. The apparatus of claim 13 comprising: a solenoid valve on said cleaning fluid flow line for effecting the opening and closing thereof and for thereby controlling the flow of cleaning fluid to the surface to be cleaned; said pump means including a motor; a first switch for controlling both said solenoid valve and said motor, said first switch being in a first circuit which is in series with each of second and third circuits, said second and third circuits being parallel to one another; said second circuit comprising said motor for said pump means; said third circuit comprising a second switch and said solenoid of said solenoid valve, said second switch being normally closed to said solenoid of said solenoid valve whereby closing of said first switch closes a circuit through said solenoid valve and through said motor for said pump, thereby simultaneously causing a flow of cleaning fluid to the surface beng cleaned and causing used cleaning fluid to be pumped from said recovery chamber; said second switch being additionally a component of a fourth circuit, said fourth circuit being parallel to said first circuit and being in series with said second circuit whereby when said second switch is manually engaged to thereby open said third circuit, said fourth circuit is closed through said second circuit and said motor for said pump operates alone with said solenoid valve being closed and the flow of liquid to the surface being cleaned thereby shut off.

15. The apparatus of claim 14 including a fifth circuit comprised of a third switch and a motor for said blower means in series with one another; said third switch also being in series with said first circuit, said motor for said blower means being arranged in parallel with said first circuit and with said second, and third, circuits whereby said third switch acts as the main power switch for said motor for said blower means and said solenoid valve.

16. The apparatus of claim 14 comprising: a contoured handle grip shaped to define a plurality of finger receiving channels, said first switch being located within one of said finger receiving channels of said contoured handle grip whereby it is conveniently located for activation as an operator operates said apparatus.

17. The apparatus of claim 12 including: shroud means over said blower means for directing the blower means discharge downwardly onto the surface being cleaned.

18. A portable surface cleaning apparatus comprising: spray means for spraying cleaning fluid onto the surface being cleaned, said spray means including a cleaning fluid flow line operably connected to a source of cleaning fluid; solenoid valve means on said cleaning fluid flow line for alternatively stopping or allowing cleaning fluid to flow therethrough to the surface to be cleaned; a used cleaning fluid recovery chamber; a suction nozzle in flow communication with said recovery chamber; blower means including a blower motor in flow communication with said recovery chamber for generating a suction in said recovery chamber for causing air and used cleaning fluid to be drawn through said suction nozzle into said recovery chamber; pump means, including a pump motor, operably connected to said recovery chamber for pumping used cleaning fluid out of said recovery chamber to a remote discharge means; a first switch for controlling both said solenoid valve and said pump motor, said first switch being in a first circuit which is in series with each of second and third circuits, said second and third circuits being parallel to one another; said second circuit comprising said pump motor; said third circuit comprising a second switch and said solenoid of said solenoid valve, said second switch being normally closed to said solenoid of said solenoid valve whereby closing of said first switch closes a circuit through said solenoid valve and through said pump motor, thereby simultaneously causing a flow of cleaning fluid to the surface being cleaned and causing used cleaning fluid to be pumped from said recovery chamber; said second switch being additionally a component of a fourth circuit, said fourth circuit being parallel to said first circuit and being in series with said second circuit whereby when said second switch is manually engaged to thereby open said third circuit, said fourth circuit is closed through said second circuit and said pump motor operates alone with said solenoid valve being closed and the flow of liquid to the surface being cleaned thereby shut off.

19. The apparatus of claim 18 including a fifth circuit comprised of a third switch and said blower motor in series with one another; said third switch also being in series with said first circuit, said blower motor being arranged in parallel with said first circuit and with said second and third circuits whereby said third switch acts as the main power switch for said blower motor and said solenoid valve.

20. The apparatus of claim 19 comprising: a contoured handle grip shaped to define a plurality of finger receiving channels, said first switch being located within one of said finger receiving channels of said contoured handle grip whereby it is conveniently located for activation as an operator operates said apparatus.

21. The apparatus of claim 18 comprising: a contoured handle grip shaped to define a plurality of finger receiving channels, said first switch being located within one of said finger receiving channels of said contoured handle grip whereby it is conveniently located for activation as an operator operates said apparatus.

22. A portable surface cleaning apparatus comprising: a suction nozzle in flow communication with a recovery chamber; blower means in flow communication with said recovery chamber for generating a vacuum in said recovery chamber and causing debris to be drawn through said suction nozzle into said recovery chamber; said blower means including an impeller and an impeller housing in which said impeller is housed, said impeller housing being open at a plurality of points around the circumference thereof to allow the discharge of air from said impeller; shroud means being positioned over said impeller housing, said shroud means including a circumferential channel positioned around said points of discharge of said impeller and creating a flow communication channel for air discharged by said impeller; said channel being open at the bottom whereby air from said impeller is discharged downwardly directly onto the surface being cleaned.

23. The apparatus of claim 22 in which said shroud means comprises a molded polymeric material of sufficiently high heat resistance to resist degradation caused by heat generated by said blower means.

24. The apparatus of claim 22 in which said portable surface cleaning apparatus includes spray means for spraying liquid onto the surface to be cleaned whereby the downward blast of discharged air effected by said shroud means serves to help dry the surface to be cleaned as said apparatus is passed over a previously wetted area.

* * * * *